US012098001B2

(12) United States Patent
Genord et al.

(10) Patent No.: US 12,098,001 B2
(45) Date of Patent: Sep. 24, 2024

(54) CONFIGURABLE HORIZONTAL DIVIDER BRIDGE SYSTEM

(71) Applicant: Walmart Apollo, LLC, Bentonville, AR (US)

(72) Inventors: Jonathan Michael Genord, Centerton, AR (US); Anna L. Isbell, Bella Vista, AR (US); Brenna Groves, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 450 days.

(21) Appl. No.: 17/324,773

(22) Filed: May 19, 2021

(65) Prior Publication Data

US 2022/0369834 A1 Nov. 24, 2022

(51) Int. Cl.

*B65D 5/498* (2006.01)
*B65D 5/50* (2006.01)
*B65D 5/52* (2006.01)

(52) U.S. Cl.

CPC ..... *B65D 5/48048* (2013.01); *B65D 5/5035* (2013.01); *B65D 5/52* (2013.01)

(58) Field of Classification Search

CPC .... B65D 5/48048; B65D 5/5035; B65D 5/52; B65D 5/48038; B65D 5/48042; B65D 5/30; B65D 5/4804; A47B 43/02; A47B 47/06; Y10S 229/931

USPC ..... 229/120.38, 120.32, 120.36, 120.05, 229/120.29, 120.03, 931; D9/456; 206/486; 53/458, 484

See application file for complete search history.

(56) References Cited

U.S. PATENT DOCUMENTS 2,844,294 A * 7/1958 Williams ..... B65D 5/30 229/120.05
7,578,427 B2 * 8/2009 Durnin ..... B65D 5/48048 229/122.26
8,033,448 B2 * 10/2011 Breitfeld ..... B65D 5/4804 229/120.31
D996,214 S * 8/2023 Genord ..... B65D 5/52 D9/456
2012/0104082 A1 5/2012 Spivey, Sr. et al.
2015/0183548 A1 7/2015 Cho
2018/0251256 A1 9/2018 Baryshyan
2019/0014927 A1 * 1/2019 Nixon ..... A47B 55/06
2019/0322408 A1 10/2019 Burda et al.
2021/0070491 A1 3/2021 Sollie et al.

* cited by examiner

*Primary Examiner* — Christopher R Demeree
(74) *Attorney, Agent, or Firm* — Foley IP Law, PLLC

(57) ABSTRACT

Examples provide a configurable divider bridge system. A divider bridge includes a tab at opposite ends of the divider bridge. The tabs insert into receiving slots inside a container, such as a display case or packing container. The receiving slots guide the tabs downward between the interior sides of the container and items placed inside the container. As the tabs slide down into the receiving slots, the side panels of the divider bridge are guided into an unfolded configuration. The slots permit installation of the divider bridge into the container which already contains soft product easily while preventing damage to the divider or the soft product. The divider bridge can be placed inside the container in a variety of configurations and/or orientations to accommodate a variety of sizes and shapes of containers and types of items being stored, transported, or displayed within the containers.

14 Claims, 17 Drawing Sheets

CONFIGURABLE HORIZONTAL DIVIDER BRIDGE SYSTEM

BACKGROUND

Soft products are goods which are not physically hard or solid. Soft products can be pliable, malleable and/or physically soft. Soft products present unique challenges for packaging, transport, and display because the items can be easily damaged or deformed. For example, when packing soft products within shipping and display cases, these items can become crushed or deformed by other items stacked on top of these items inside the same case. Likewise, soft products inside case(s) in a stack can become damaged due to the weight of other cases stacked on top of the packaging case(s). Soft products can be packed into smaller, reinforced containers to prevent product damage. However, utilization of smaller cases increases the number of cases required, which can be costly and inefficient.

SUMMARY

Some examples provide a configurable divider bridge system. The system includes a display case and at least one divider bridge. The display case has a first receiving slot associated with an interior surface of a first side member and a second receiving slot associated with the interior surface of a second side member. The first receiving slot opposite to the second receiving slot. The divider bridge includes a first guide tab associated with a first side panel. The first guide tab is sized to fit within the first receiving slot. The first receiving slot guides the first side panel between the first side member of the interior surface of the display case and at least one item located within a storage space associated with an interior space within the display case downward toward a base member of the display case when the first tab is engaged with the first receiving slot during installation of the divider bridge into the display case. A second guide tab associated with a second side panel. The second guide tab sized to fit within the second receiving slot. The second receiving slot guides the second side panel between the second side member of the interior surface of the display case and at least one item located within a storage space associated with the bottom half of the interior of the display case downward toward the base member of the display case when the second tab is engaged with the second receiving slot during installation of the divider bridge into the display case. A horizontal panel has a length equal to a length of the display case and a width equal to the width of the display case. The horizontal panel is parallel to the base member when the divider bridge is in an unfolded configuration. The horizontal panel with the first side panel and the second side panel define a reinforced storage space for the at least one item.

Other examples provide a method for case packing utilizing a configurable divider bridge. A first guide tab is inserted into a first receiving slot disposed within an interior surface of a first side member of a display case in response to a determination that a storage space within the display case has reached a threshold level. The first receiving slot guides the first side panel into first position between the first side member and at least one item located within an interior space of the display case until the first side member contacts a portion of a base member. A second guide tab is inserted into a second receiving slot disposed within an interior surface of a second side member of the display case. The second receiving slot guides the second side panel into a second position between the second side member and the at least one item located within the interior space of the display case until the second side member contacts at least a portion of the base member. A horizontal panel is placed into an unfolded configuration parallel to the base member. The horizontal panel forms a divider for separating a first set of items located within a bottom section of the interior of the display case from a top section of the interior of the display case.

Still other examples provide a configurable divider bridge. The divider bridge includes a guide tab associated with a first side panel. The guide tab is sized to fit within a receiving slot of a display case. The receiving slot guides the first side panel between an interior surface of a first side member of the display case and a set of items associated with an interior space of the display case as the configurable divider bridge is unfolded. A second side panel is sized to fit between the interior surface of a second side member of the display case and the set of items. A horizontal panel is parallel to a base member of the display case when the divider bridge is in an unfolded configuration. The horizontal panel with the first side panel and the second side panel define a reinforced storage space for the set of items within the display case.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Corresponding reference characters indicate corresponding parts throughout the drawings.

DETAILED DESCRIPTION

Figure 1:
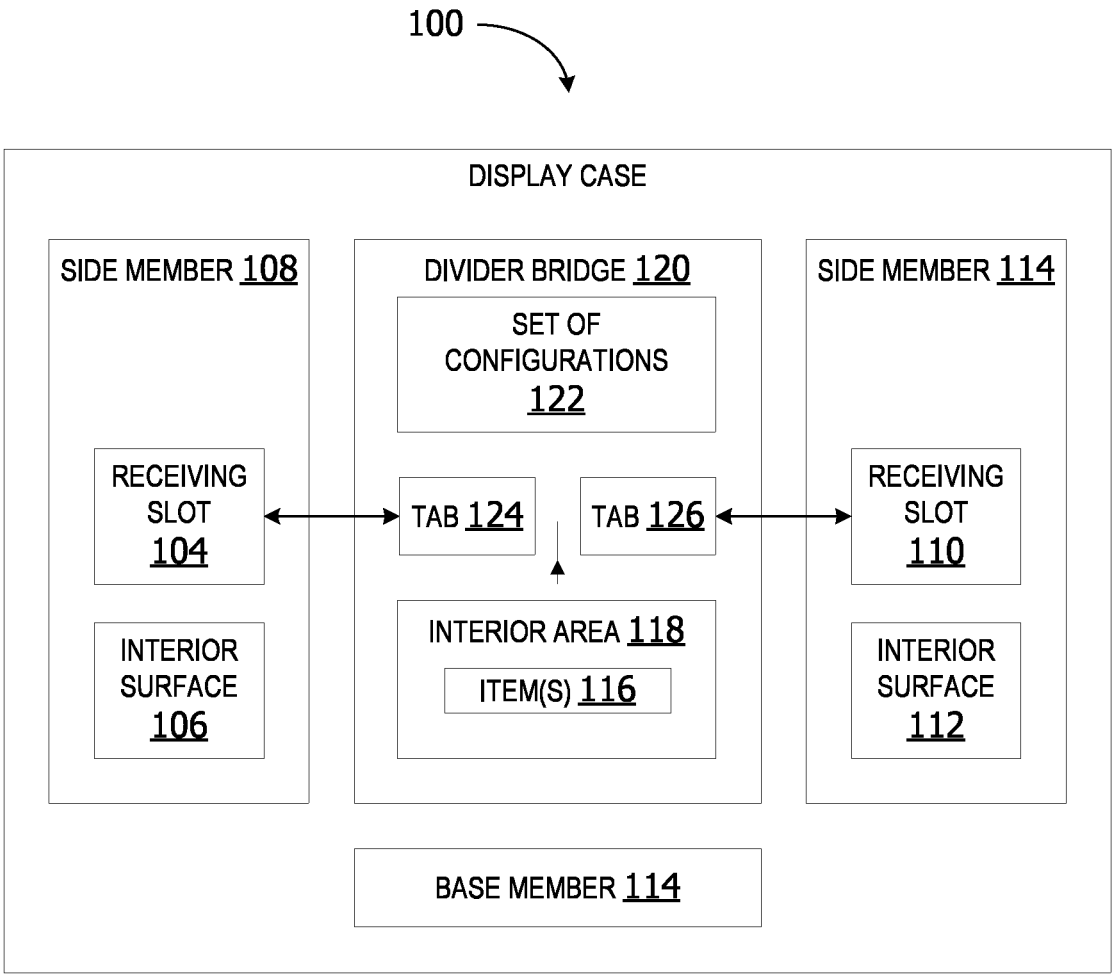
FIG. 1 is an exemplary block diagram illustrating a configurable horizontal divider bridge system for case packing, item transport and/or item display.

A more detailed understanding can be obtained from the following description, presented by way of example, in conjunction with the accompanying drawings. The entities, connections, arrangements, and the like that are depicted in, and in connection with the various figures, are presented by way of example and not by way of limitation. As such, any and all statements or other indications as to what a particular figure depicts, what a particular element or entity in a particular figure is or has, and any and all similar statements, that can in isolation and out of context be read as absolute and therefore limiting, can only properly be read as being constructively preceded by a clause such as "In at least some examples, . . . " For brevity and clarity of presentation, this implied leading clause is not repeated ad nauseum.

Soft items can be easily damaged during packaging, transit and/or display in cases in which multiple items are stacked inside one or more cases. Dividers can be used inside a case to separate items and reduce likelihood of damage to stacked soft items inside cases. However, placing dividers inside a case during product packing, as the items are being placed into the packing case, can be a time-consuming, difficult, and labor intensive process due to the difficulties associated with correctly placing the dividers around and between product inside the case. Placing dividers can require multiple attempts, as well as result in damage to product if the dividers are placed incorrectly. This can be a costly, frustrating, and inefficient process.

Referring to the figures, examples of the disclosure enable a divider bridge insert and display case having receiving tabs for guiding the divider bridge into place during packing of soft product into the display case. In some examples, a pair of opposing tabs on each side member of the divider bridge slides into the receiving slots on the interior of the display case to guide the divider bridge side members between the side walls of the display case and the product already placed into the bottom portion of the display case. This permit easy placement of the divider without distracting a user from packing cases.

In some examples, the divider bridge guide tabs provide the ability to get the divider into cases quickly with minimal labor. The divider bridge reduces the number of personnel required to install dividers during packing of cases. The divider further provides faster and easier assembly of packing cases with dividers.

Referring again to FIG. 1, an exemplary block diagram illustrates a configurable horizontal divider bridge system 100 for case packing, item transport and/or item display. A display case 102, in some examples, include a first receiving slot 104 associated with an interior surface 106 of a first side member 108 and a second receiving slot 110 associated with the interior surface 112 of a second side member 114. The first receiving slot 104 is opposite to the second receiving slot 110. In some examples, the receiving slots are located on interior side walls of the display case. In other examples, the receiving slots are located on the front and back walls of the display case 102.

The display case 102 is a container for storing, transporting and/or displaying one or more items 116 within an interior area 118 of the display case 102. The display case 102 can be implemented as, for example but without limitation, a box, tote, bin, basket, cart, or any other container having at least four sides and a base member 114. The base member 114 is a bottom panel. The display case 102 may optionally include a lid, cover, or other top to secure contents of the display case during transport or movement of the display case. In some non-limiting examples, the display case 102 includes a set of two or more flaps which fold downward to form a closed top member (lid) for sealing the contents of the display case 102 after packing of the display case 102 is complete. In this non-limiting example, the display case 102 is a consumer facing display case for use in a retail environment, as well as a shipping container for storing/transporting items.

The display case 102 may be constructed of a variety of materials. In some non-limiting examples, the display case 102 is made of a corrugated material. The display case 102, in these examples, can include a cardboard box. In other examples, the display case 102 can be constructed of paper, plastic, wood, a composite material, or any other suitable material.

The display case 102 stores the one or more items 116 within the interior area 118. The item(s) 116 can include any type of items, such as, but not limited to, comestibles (food), apparel, household goods, pet supplies, shoes, toys, or any other type of items. In some examples, the display case 102 stores soft product, such as sausage or other meat products. However, the item(s) 116 of the examples are not limited to meat products. In other examples, the items stored and/or displayed in the display case 102 include socks, bread, light bulbs, or any other type of items. The item(s) 116 may be referred to as products or goods.

A divider bridge 120 is a configurable divider capable of insertion into the display case 102 during packing of the display case 102 in a set of configurations 122. In some examples, the divider bridge 120 forms a "U" shaped configuration in which a horizontal panel rests on top of a flat surface and two side members extend upward on each side to form a letter U shape. In other examples, the divider bridge 120 can be folded into an upside-down "U" shaped configuration in which the horizontal panel sits on top of the downward oriented side panels to form an upside-down U shape beneath which items may be placed for storage, transport or display within the display case 102. The horizontal panel forms a platform on which items may be stacked.

In other examples, the divider bridge 120 is unfolded into a "M" shaped configuration in which two side panels and a middle panel support a horizontal panel to form a letter M shape inside the display case 102. In other examples, the divider bridge is unfolded with the horizontal panel on bottom and the two side panels and middle panel oriented upward to form a W shape within the display case 102.

In some examples, a first guide tab 124 associated with a first side panel of the divider bridge 120. The first guide tab 124 is sized to fit within the first receiving slot 104 as the divider bridge 120 is being unfolded and installed within the display case 102. The first receiving slot 104 guides the first side panel between the first side member 108 of the interior surface 106 of the display case 102 and the one or more item(s) 116 located within an interior area 118 (storage space) of the display case 102 downward toward the base member 114 when the first guide tab 124 is engaged with the first receiving slot 104.

A second guide tab 126 is associated with a second side panel of the display case 102. The second guide tab 126 is sized to fit within the second receiving slot 110. The second receiving slot 110 forms a channel or guide that directs the tab 126 of the second side panel between the second side member 114 of the interior surface of the display case 102 and the one or more item(s) 116 toward the base member 114 within the interior area 118 of the display case without damaging the item(s) 116.

Figure 2:
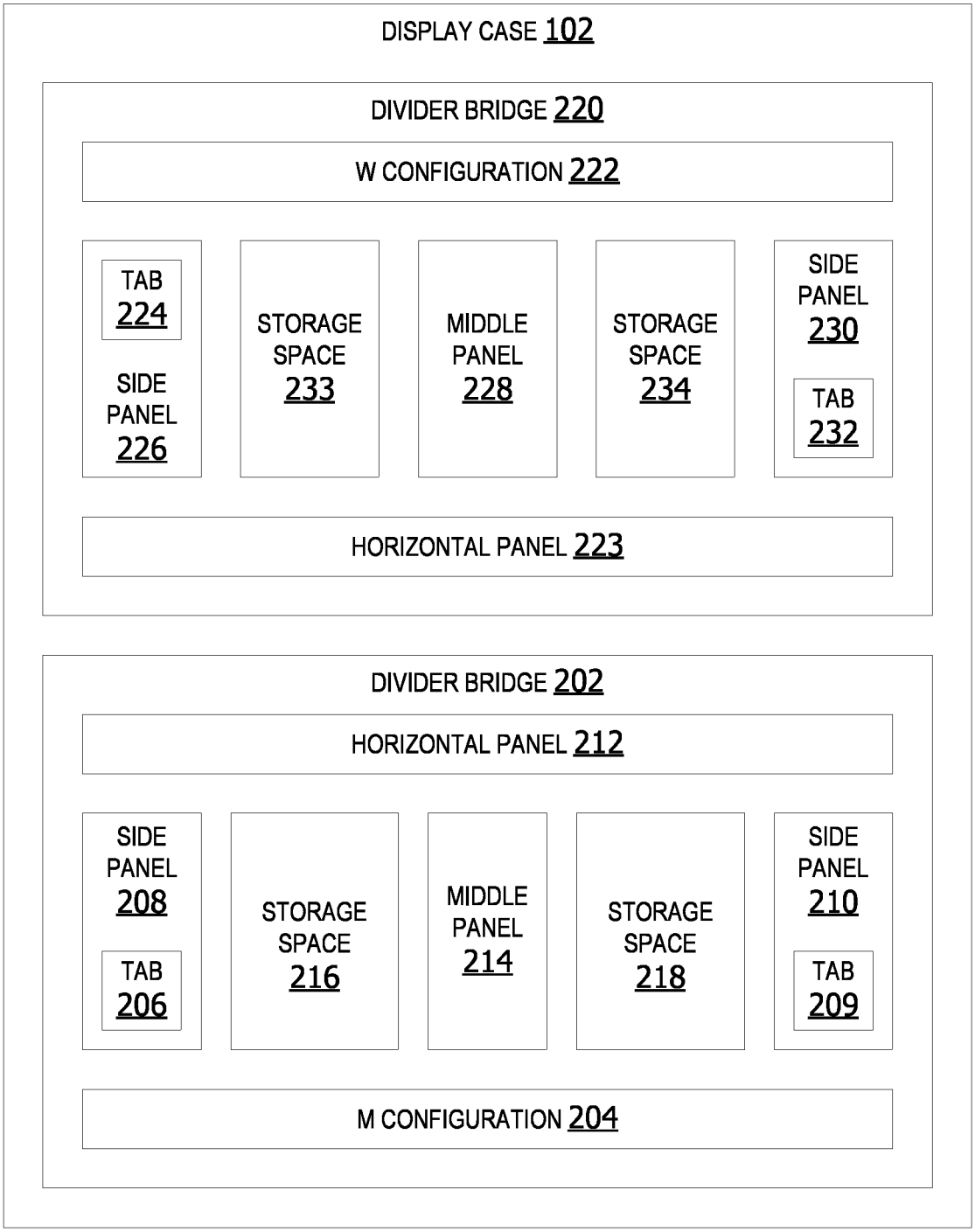
FIG. 2 is an exemplary block diagram illustrating a display case including a set of divider bridges.

FIG. 2 is an exemplary block diagram illustrating a display case 102 including a set of divider bridges. The first divider bridge 202 is a divider, such as, but not limited to, the divider bridge 120 in FIG. 1. The first divider bridge 202, in this non-limiting example, is a divider bridge in an M configuration 204 at the bottom portion of the display case 102.

The first divider bridge 202 includes a first guide tab 206 at a first end of a first side panel 208. The first guide tab 206 is sized to fit within a first receiving slot in an interior side wall of the display case. The first receiving slot is a guide or channel configured to direct the side panel 208 into a proper position during installation of the divider bridge 202 within a partially filled display case 102, such as, but not limited to, the first receiving slot 104 in FIG. 1. The first receiving slot can be disposed within any interior side wall of the display case to guide the tab 206 downward between the side wall and the item(s) which at least partially fill the display case 102.

A second guide tab 209 is associated with a second side panel 210 of the divider bridge 202. The second guide tab 209 is sized to fit within the second receiving slot and slide down a channel or interior space defined by the receiving slot between an exterior side wall and the interior side wall of the display case 102. The second receiving slot is a slot within an interior wall of the display case, such as, but not limited to, the second receiving slot 110 in FIG. 1.

In some examples, the second receiving slot forms a channel or space between an interior wall and exterior wall of the side member of the display case. The receiving slot guides the second side panel between the second side member of the interior surface of the display case and at least one item located within the bottom portion of the display case. The channel or guide formed by the receiving slot directs the guide tab downward toward the base member of the display case when the second guide tab is engaged with the second receiving slot during installation of the divider bridge into the display case.

A horizontal panel 212, in some examples, has a length approximately equal to or slightly less than the length of the base member of the display case. In other examples, the horizontal panel 212 has a width equal to or slightly less than the width of the bottom member of the display case in the folded configuration. The horizontal panel 212 fits within the display case to form a platform having an area substantially equal to the area of the base member. The horizontal panel 212 in this example is parallel to the base member when the divider bridge is in an unfolded configuration and inserted into the display case 102.

A middle panel 214 folds along a fold line to form a middle support between the first side panel 208 and the second side panel 210. The middle panel 214 is perpendicular to the horizontal panel 212 when the divider bridge is in a folded M configuration within the display case 102.

The horizontal panel 212, the first side panel 208 and the middle panel 214 defines a first reinforced storage space 216 for the at least one item when the divider bridge is in the M configuration. The horizontal panel 212, the second side panel 210 and the middle panel 214 define a second reinforced storage space 218 when the divider bridge 202 is folded into the M configuration.

A second divider bridge 220 is a divider, such as, but not limited to, the divider bridge 120 in FIG. 1. The second divider bridge 220 in this non-limiting example, is folded into a W configuration 222 within the display case 102. In this example, the second divider bridge 220 is installed within a top portion of the display case 102, substantially on top of the first divider bridge 202. In other words, a horizontal panel 223 of the divider bridge 220 rests on top of the horizontal panel 212 of the first divider bridge 202, in this non-limiting example. Thus, the second divider bridge 220 is installed after the first divider bridge is successfully installed in the M configuration 204 prior to installing the second divider bridge 220 in the W configuration 222.

The divider bridge optionally includes a guide tab 224 at the end of a side panel 226. However, in the W configuration, the guide tab 224 is unnecessary. In other words, it is not necessary for the user to insert the guide tab 224 into a receiving slot during assembly/installation of the divider bridge 220 in the W configuration within the display case 102.

The first side panel 226, the horizontal panel 223 and a middle panel 228 define a third reinforced storage space 233 within the display case for storing and/or displaying one or more items.

A second side panel 230 optionally incudes a guide tab 232. However, the guide tab 232 is not inserted into a receiving slot in this non-limiting example. The side panel 230, a portion of the horizontal panel 223 and the middle panel 228 define a fourth reinforced storage space 234 within the display case interior area for storing and/or displaying one or more items. The storage spaces defined by the two divider bridges are reinforced by the side panels, middle panels, and horizontal panels of the divider bridges. The divider resets the weight allowing more product to be put on top of the divider bridge without damaging the product in the bottom of the case.

In other examples, the W configuration divider bridge on top creates center support to reduce pressure on the center of the case in a mixed load. The divider provides strength to the case while reducing the amount of corrugated board required for construction of the case. The divider reduces and/or prevents the box from bending/breaking under pressure. This provides increased cost savings, reduces loss due to damaged product and adds integrity to case.

Figure 3:
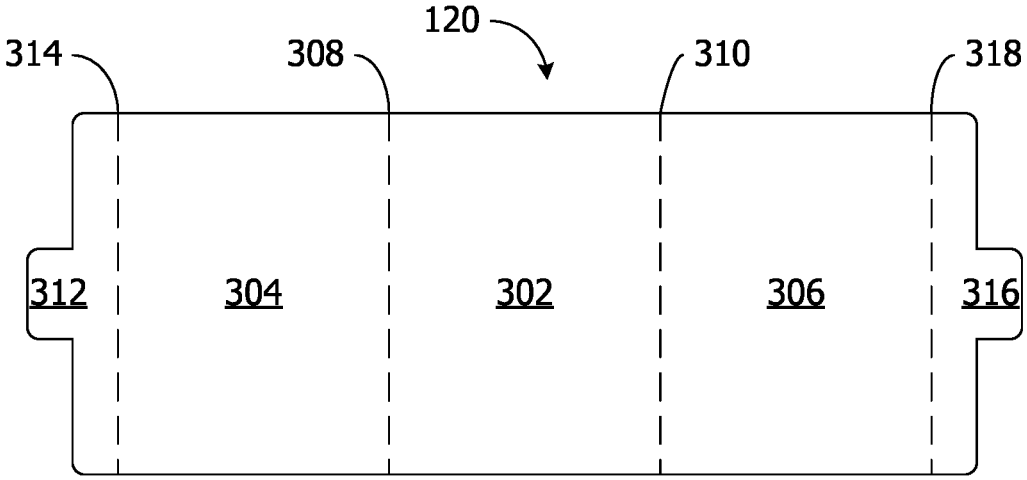
FIG. 3 is an exemplary block diagram illustrating a three-panel divider bridge in an unfolded configuration.

FIG. 3 is an exemplary block diagram illustrating a three-panel divider bridge 120 in an unfolded configuration. In this non-limiting example, the divider bridge 120 includes a horizontal panel, a first side panel 304 and a second side panel 306. A first fold line 308 separates the first side panel from the horizontal panel 302. A second fold line 310 separates the second side panel from the horizontal panel 302. In this unfolded configuration, the divider bridge lies substantially flat. The side panels are not folded along the fold lines.

A fold line is a line created within the divider bridge along which a member or panel of the divider bridge may be folded. In some examples, the fold line is a perforated line. In other examples, the fold line is a creased line or seam along which a member or panel of the divider bridge can be folded. In still other examples, the fold line includes a marking or dashed line visually identifying the fold line.

In some examples, during assembly, the side panels 304 and 306 are folded along the fold lines 308 and 310 to create a substantially U shaped configuration of the divider bridge for installation into a display case, such as, but not limited to, the display case 102 in FIG. 1.

The divider bridge 120 includes a first guide tab 312. The first guide tab is associated with a side or end of the side panel 304. A fold line 314, in this example, separates the guide tab 312 from the side panel 304. During installation, the tab 312 is folded at the fold line 314 for insertion of the tab 312 into the receiving slot on the display case.

A second guide tab 316 is abuts the second side panel 306. In this example, the guide tab 316 is contiguous with the side panel. A fold line 318 separates or defines a boundary separating the side panel 306 from the guide tab 316. A user folds the side panel 306 along the fold line 310 and the fold line 318 during installation of the divider bridge into the display case 102.

Figure 4:
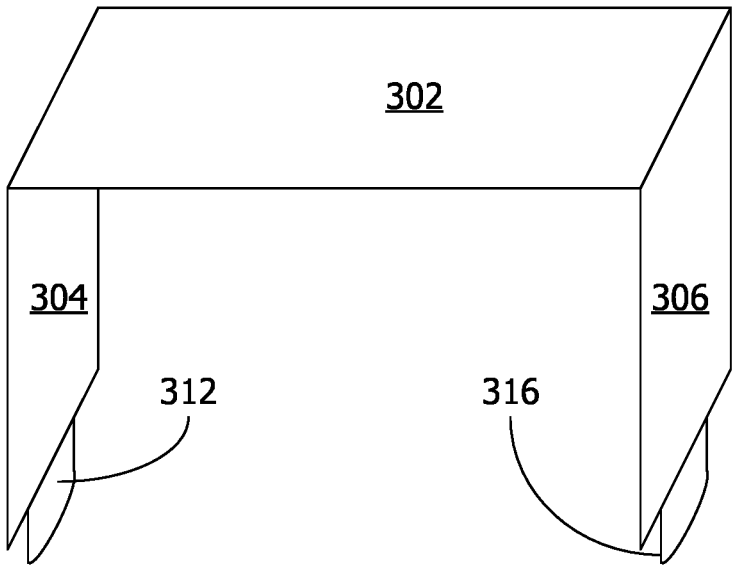
FIG. 4 is an exemplary block diagram illustrating a three-panel divider bridge in a folded configuration.

FIG. 4 is an exemplary block diagram illustrating a three-panel divider bridge 120 in a folded configuration. In this example, the divider bridge 120 is folded along the fold lines to form an upside-down U shaped configuration. The horizontal panel 302, side panel 304 and side panel 306 define a reinforced storage space for one or more items stored and/or displayed within the display case.

When installed inside a display case (not shown), the tab 312 is fully inserted into a receiving slot in a first side member of the display case. The tab 316 is fully inserted into an opposite receiving slot in a second side member of the display case when the divider bridge is fully and correctly installed within the display case.

Figure 5:
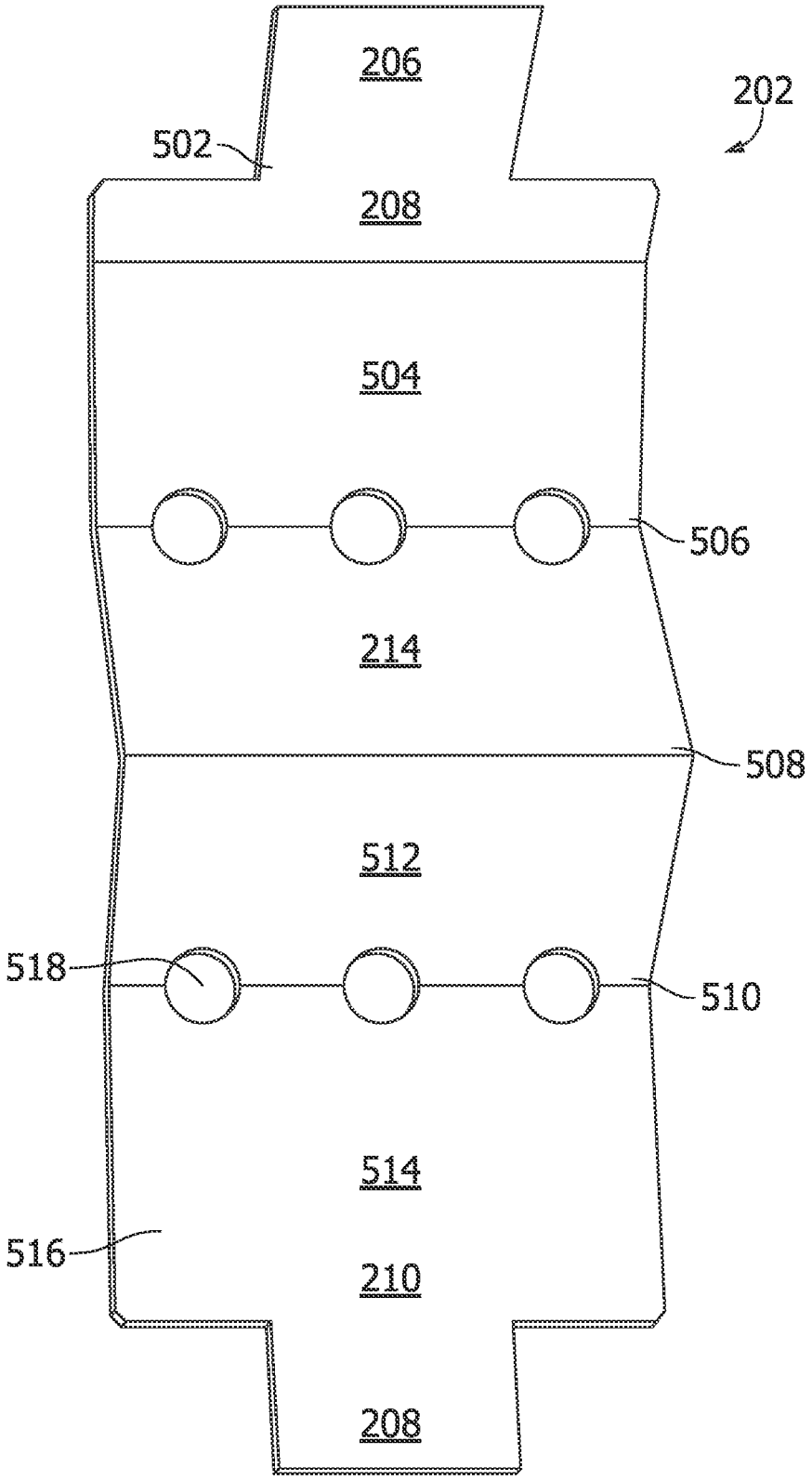
FIG. 5 is an exemplary block diagram illustrating a divider bridge including a middle panel in an unfolded configuration.

FIG. 5 is an exemplary block diagram illustrating a divider bridge 202 including a middle panel 214 in an unfolded configuration. The divider bridge 202 includes a first guide tab associated with a first side panel 208. A fold line 502 separates the tab 206 from the side panel 208. The guide tab is folded along the fold line 502 prior to insertion of the guide tab 206 into a receiving slot in the display case.

The side panel 208 is separated from a first half 504 of the horizontal panel. A fold line 506 separates the first half 504 of the horizontal panel from the first half 508 of the middle panel 214. A fold line 510 separates a second half 512 of the middle panel 214 from a second half 514 of the horizontal panel. A fold line 516 separates the second side panel 210 from the second guide tab 209. The divider bridge is folded along the fold lines during installation of the divider tab into the display case.

In some non-limiting examples, a set of one or more holes, such as, but not limited to, the hole 518, are optionally provided. The hole(s) are sized to enable a user to place one or more of their fingers through the one or more holes during installation or removal of the divider bridge. In other words, a user can place their fingers through the holes to grip the divider bridge in its folded configuration within the display case and use the finger grips to pull the divider bridge out of the display case. The horizontal panel of the divider bridge is flat and smooth when installed inside the display case. In these examples, the grip holes provide a mechanism by which a user can secure a hold on the divider bridge to pull it out of the display case to enable access to items stored below the divider bridge.

Figure 6:
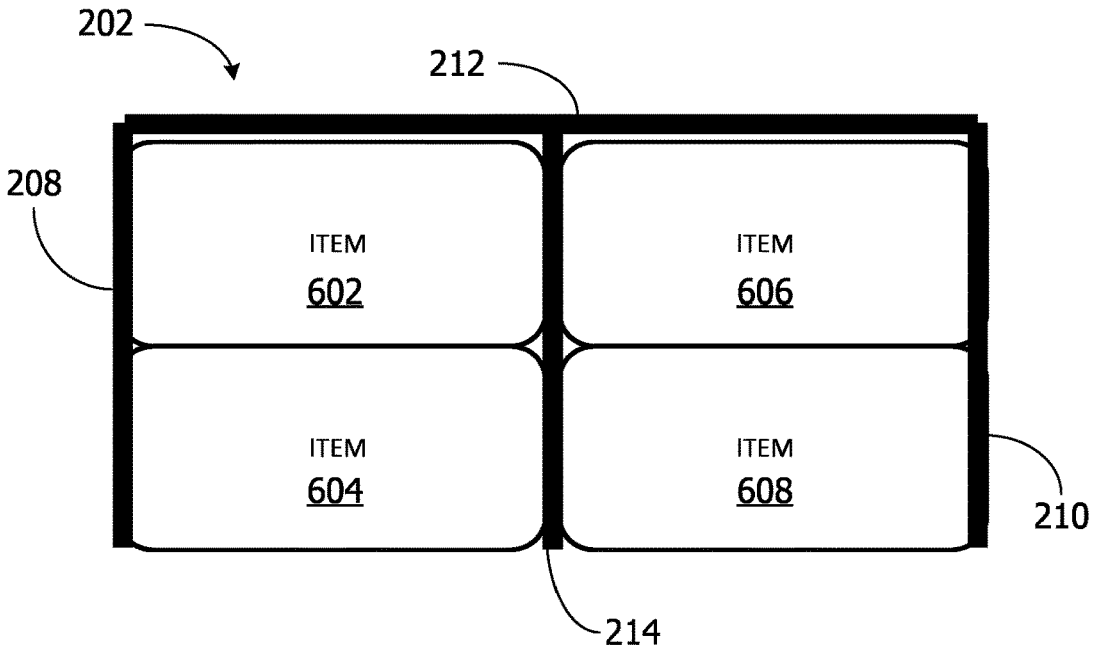
FIG. 6 is an exemplary block diagram illustrating a divider bridge in an "M" configuration.

FIG. 6 is an exemplary block diagram illustrating a divider bridge 202 in an "M" configuration. The divider bridge 202 forms a letter M shape defining a first reinforced storage area for storing items, such as, but not limited to, the item 602 and the item 604. The divider bridge 202 forms a second reinforced storage area for storing and/or displaying items, such as, but not limited to, the item 606 and item 608. In this example, the first reinforced storage area is defined by the first side panel 208, a portion of the horizontal panel 212 and the middle panel 214. The second reinforced storage area is defined by the second side panel 210, a portion of the horizontal panel 212 and the middle panel 214.

In this non-limiting example, the divider bridge is completely installed in the M configuration. In this configuration, the first side panel goes up (vertically) between the side of the box and items in the box, the horizontal panel goes across (covering at least some of the items in the bottom portion of the box), the first half of the middle panel goes down (vertically) to the base member, the other half of the middle panel goes up (vertically) from the base member to the horizontal panel, the horizontal panel goes across (horizontally) to at least partially cover at least some of the items in the bottom portion of the box, and then the second side panel goes down (vertically) between the side of the box and the items inside the box.

Figure 7:
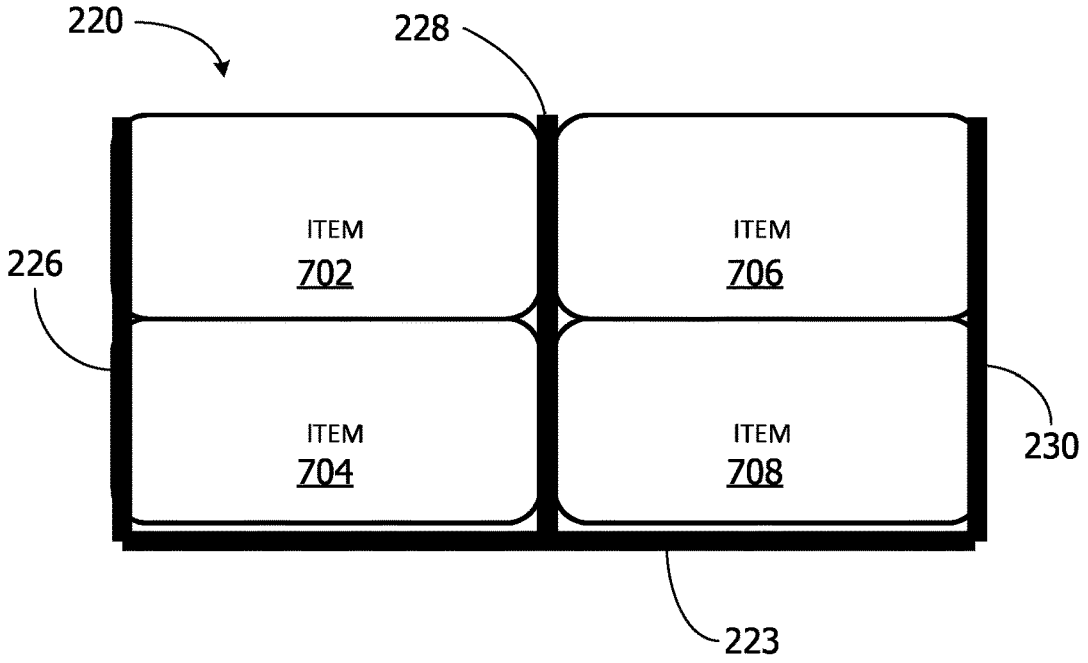
FIG. 7 is an exemplary block diagram illustrating a divider bridge in a "W" configuration.

FIG. 7 is an exemplary block diagram illustrating a divider bridge 220 in a "W" configuration. The divider bridge 220 forms a letter W shape defining a third reinforced storage area for storing items, such as, but not limited to, the item 702 and the item 704. The divider bridge 220 forms a fourth reinforced storage area for storing and/or displaying items, such as, but not limited to, the item 706 and item 708. In this example, the third reinforced storage area is defined by the first side panel 226, a portion of the horizontal panel 223 and the middle panel 228. The fourth reinforced storage area is defined by the second side panel 230, a portion of the horizontal panel 223 and the middle panel 228.

In this non-limiting example, the divider bridge is completely installed in the W configuration. In this configuration, the first side panel goes down between the side wall of the box and the items inside the box, the horizontal panel goes across (horizontally), one half of the middle panel goes up (vertically), the second half of the middle panel goes down, the horizontal panel goes across (horizontally) and the second side panel goes up (vertically).

Figure 8:
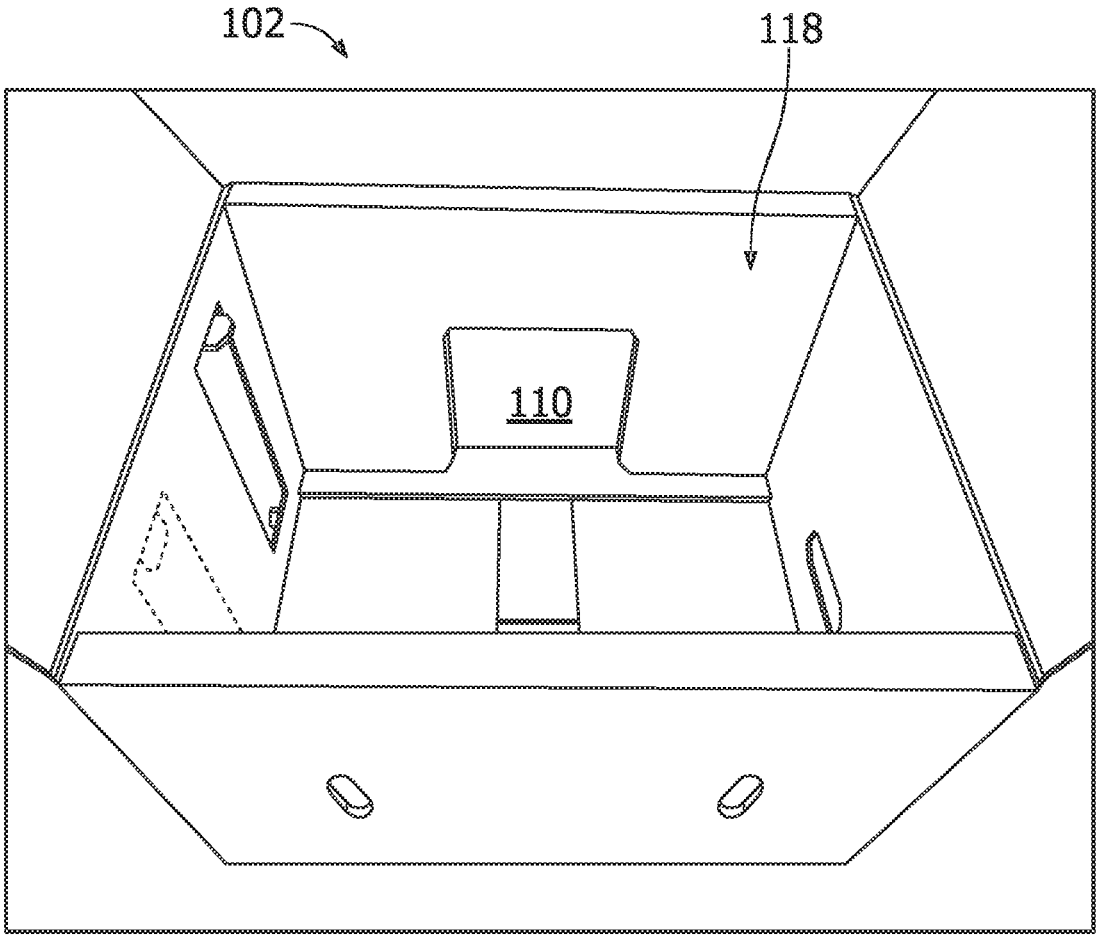
FIG. 8 is an exemplary block diagram illustrating a case having a receiving slot in an interior side wall of the case.

FIG. 8 is an exemplary block diagram illustrating a case 102 having a receiving slot 110 in an interior side wall of the case. The display case 102 is a container for storing, transporting and/or displaying one or more items 116 within an interior area 118 of the display case 102. In some examples, a second receiving slot is located opposite the first receiving slot 110 within a second interior side wall of the case 102.

Figure 9:
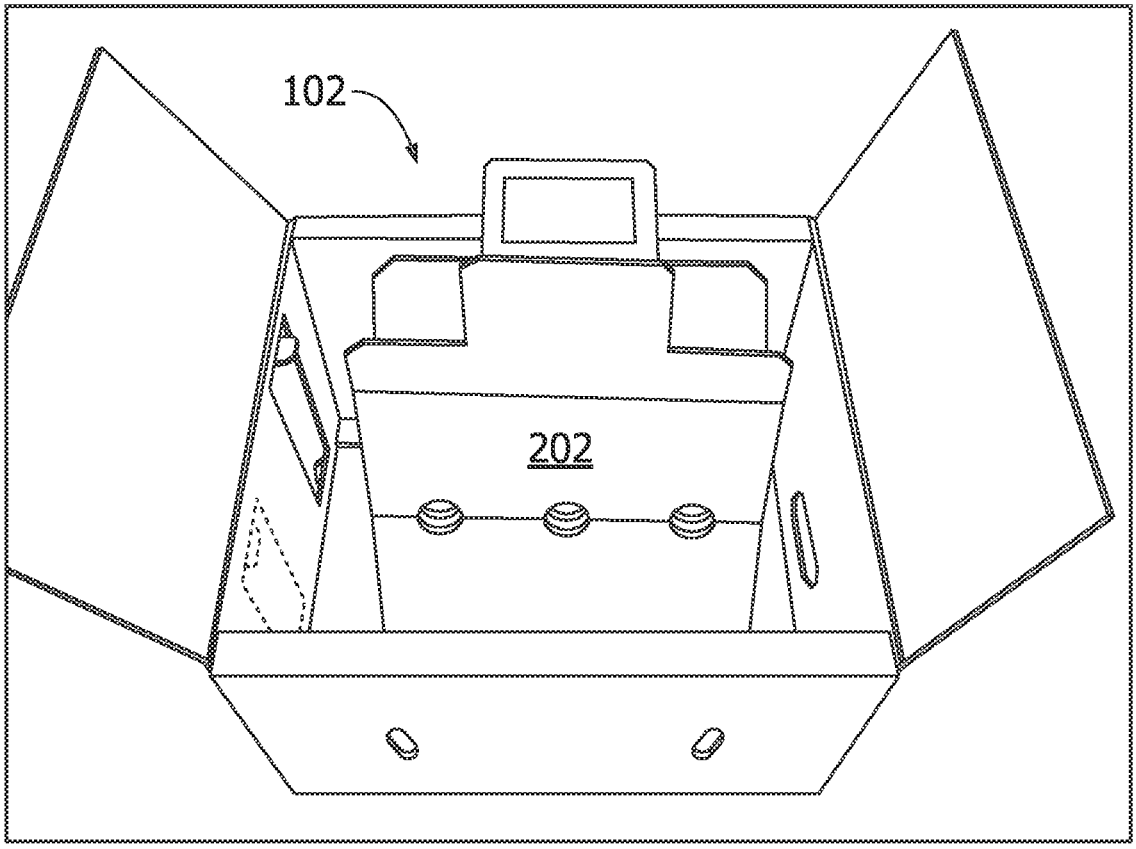
FIG. 9 is an exemplary block diagram illustrating a display case including a divider bridge in a partially folded configuration placed in the interior of the case.

FIG. 9 is an exemplary block diagram illustrating a display case 102 including a divider bridge 202 in a partially folded configuration placed in the interior of the case 102. The divider bridge 202, in this example, is placed inside the interior area of the display case prior to placing any items (product) into the case 102. The divider bridge 202 is in a partially folded configuration in which the divider bridge is folded in half along a fold line separating a first half of the middle panel from a second half of the middle panel. In this partially folded configuration, both tabs on each side panel are substantially lined up with each other and the first half and second half of the middle panel are folded against each other and touching. Thus, in the partially folded configuration, the divider bridge is folded in half such that one half of the divider bridge is aligned and in contact with the second half of the divider bridge.

In other examples, one or more items are stacked inside the interior area of the case 102 on each side of the middle panel of the partially folded divider bridge. When the case is half full (reaches a threshold level), the divider bridge is folded along the fold lines separating the middle panel from the horizontal panel, as shown in FIG. 10 below.

Figure 10:
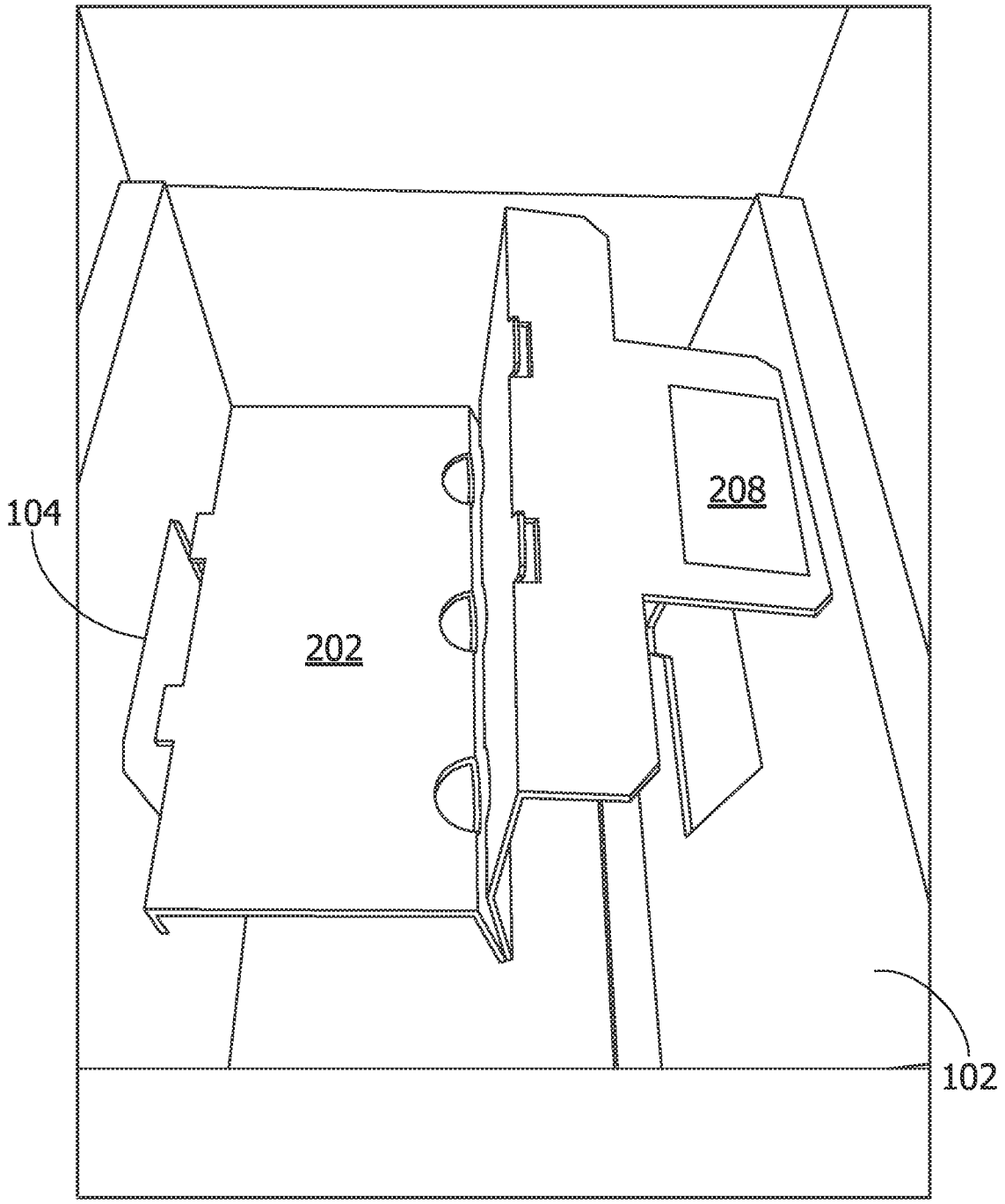
FIG. 10 is an exemplary block diagram illustrating a divider bridge having one tab inserted into one receiving slot in a display case.

FIG. 10 is an exemplary block diagram illustrating a divider bridge 202 having one tab inserted into one receiving slot in a display case 102. In this non-limiting example, the second guide tab 2098 is not yet inserted into the second receiving slot in this partially folded configuration during installation. As shown here, the middle panel is folded along the fold lines separating the middle panel from the horizontal panel.

Figure 11:
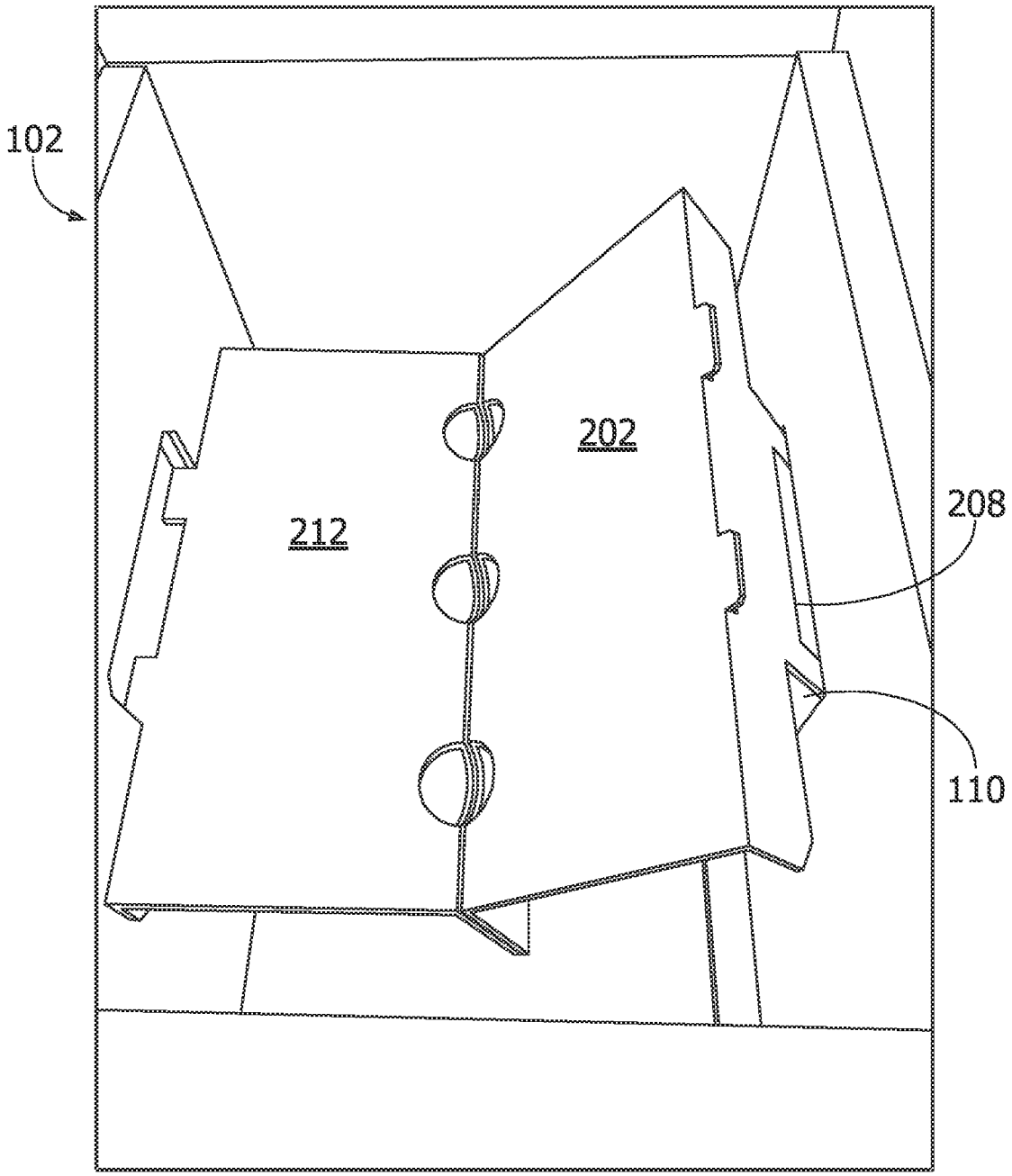
FIG. 11 is an exemplary block diagram illustrating a divider bridge having one tab inserted into a receiving slot and another tab partially inserted into another receiving slot.

FIG. 11 is an exemplary block diagram illustrating a divider bridge 202 having one tab inserted into a receiving slot and another tab 209 partially inserted into another receiving slot 110. A set of holes in the horizontal panel 212 facilitate removal of the divider bridge from the case 102.

Figure 12:
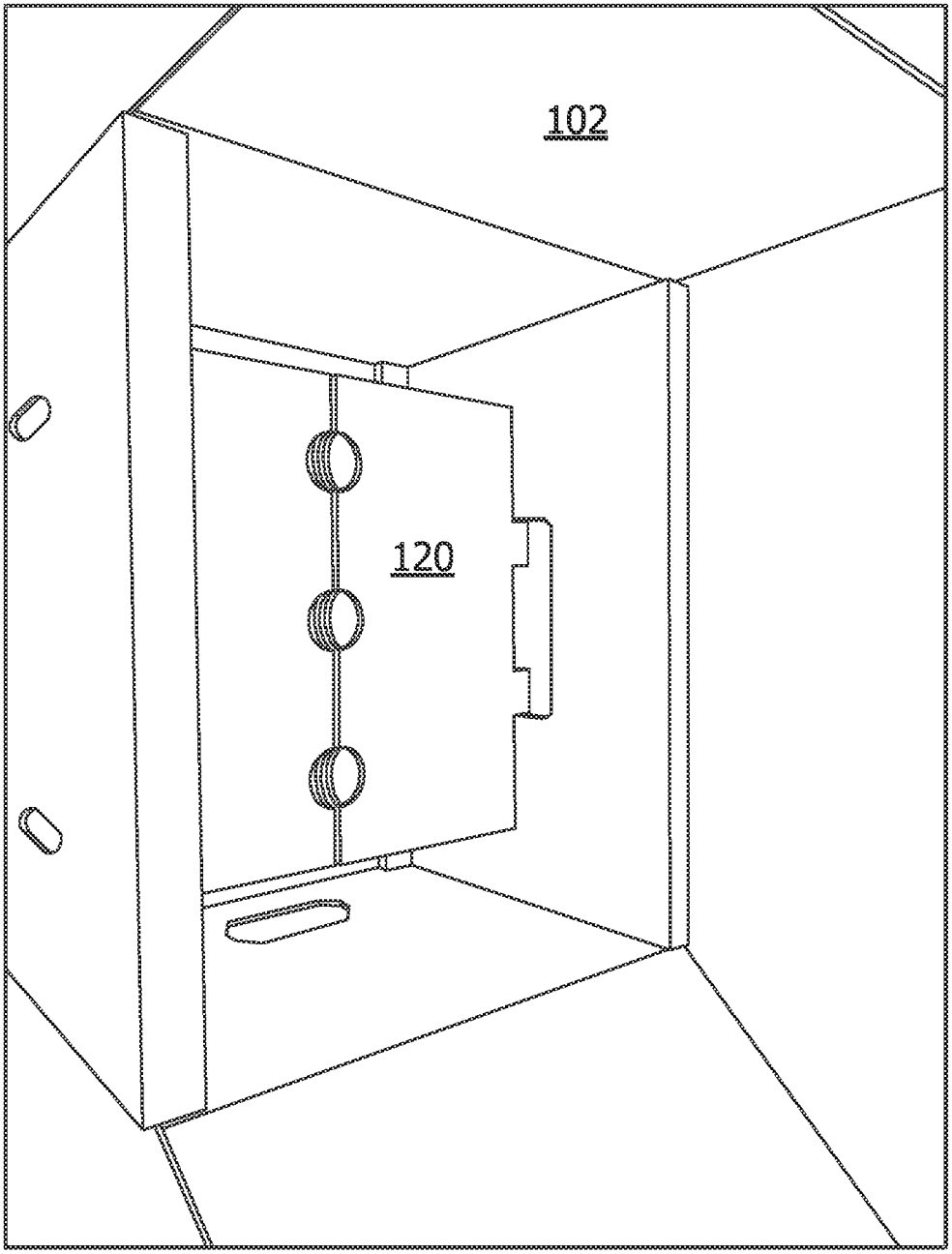
FIG. 12 is an exemplary block diagram illustrating a divider bridge in a folded configuration having both tabs inserted into corresponding receiving slots in a display case.

FIG. 12 is an exemplary block diagram illustrating a divider bridge 120 in a folded configuration having both tabs inserted into corresponding receiving slots in a display case 102. The divider bridge 120, in this example, can be in an upside-down U configuration or an M configuration. Both guide tabs are fully engaging with the receiving slots on the display case to secure (lock) the divider into place inside the case 102.

Figure 13:
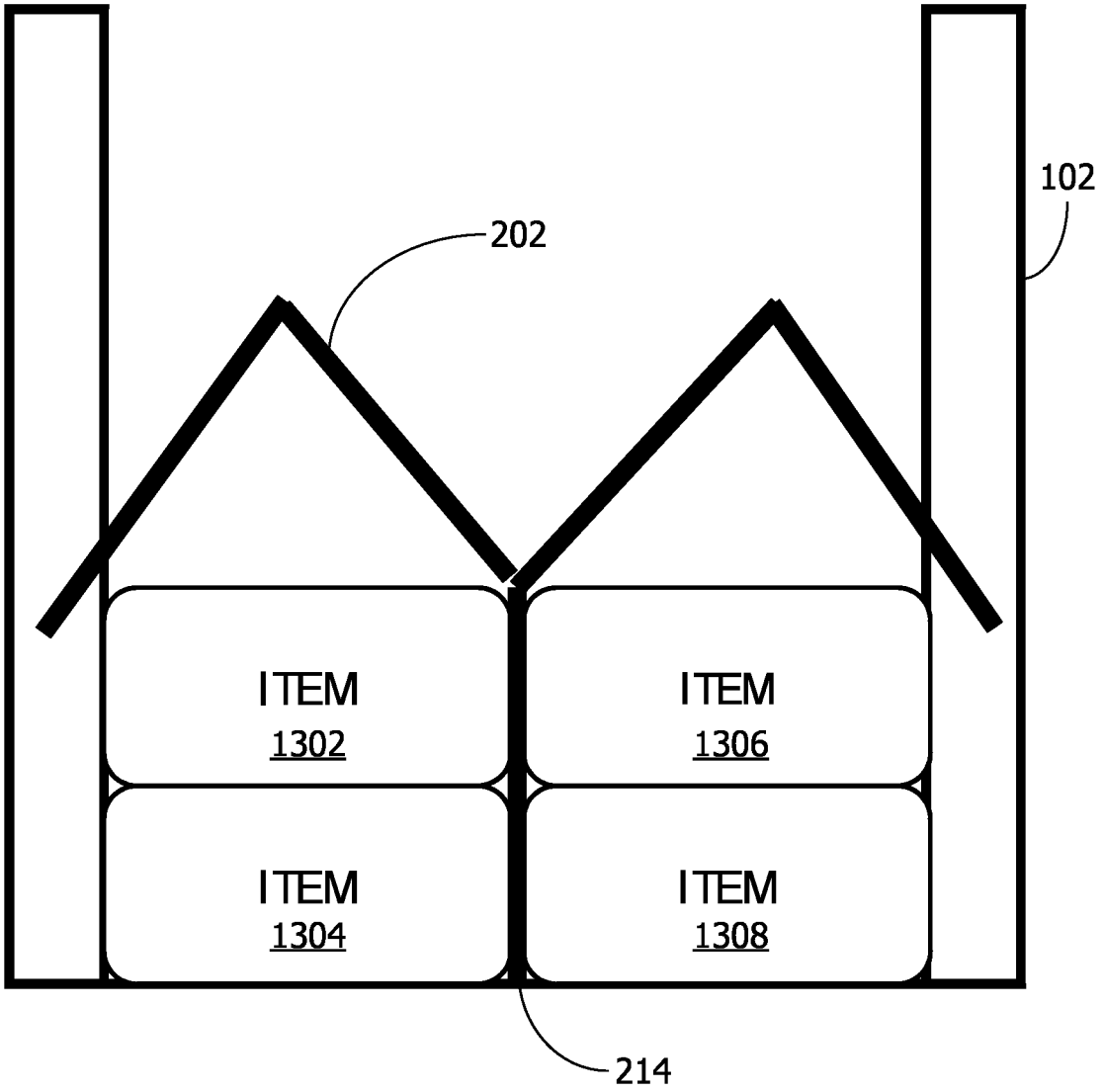
FIG. 13 is an exemplary block diagram illustrating a divider bridge in a partially folded configuration having both tabs partially inserted into both receiving slots in a display case.

FIG. 13 is an exemplary block diagram illustrating a divider bridge 202 in a partially folded configuration having both tabs partially inserted into both receiving slots in a display case 102. In this non-limiting example, a first set of items are included on a first side of the middle panel 214. The first set of items includes one or more items. The first set of items in this non-limiting example includes an item 1302 and an item 1304. However, the examples are not limited to two items. In other examples, the first set of items beneath the horizontal penal and to one side of the middle panel can include a single item, as well as three or more items.

A second set of items are included on the opposite side of the middle panel 214. In this example, the second set of items includes an item 1306 stacked on top of an item 1308. However, the examples are not limited to two items. In other examples, the second set of items can include a single item, as well as three or more items.

Figure 14:
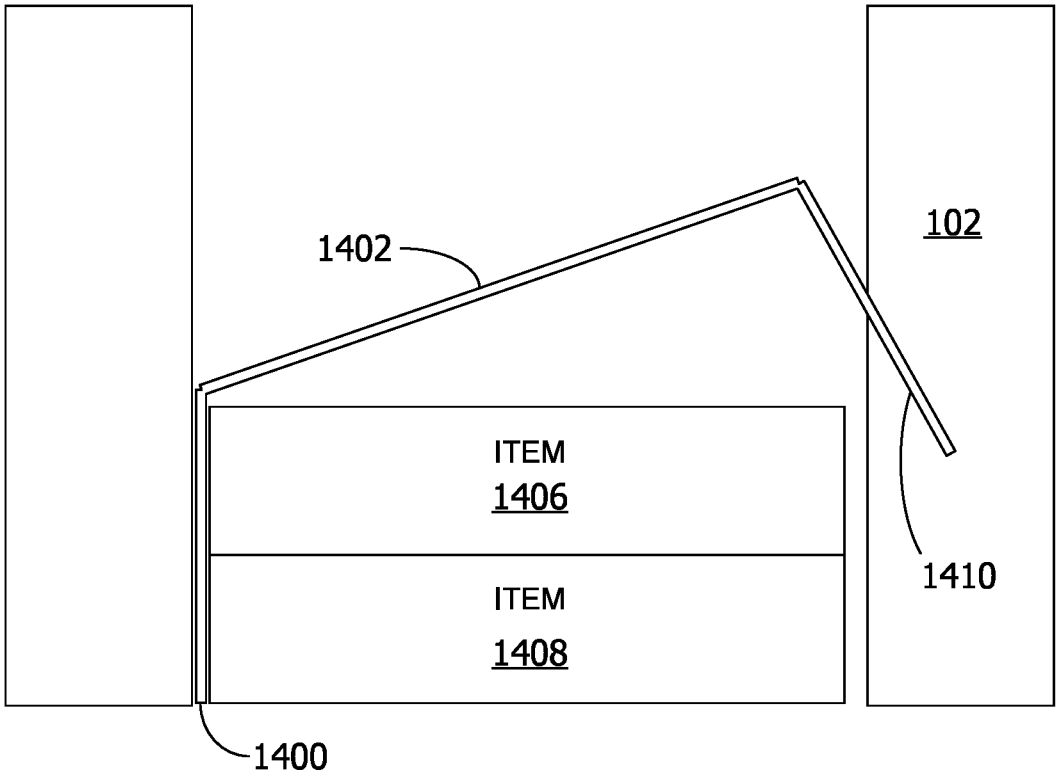
FIG. 14 is an exemplary block diagram illustrating a divider bridge having a single guide tab partially inserted into a single slot in the display case.

FIG. 14 is an exemplary block diagram illustrating a divider bridge 1402 having a single guide tab partially inserted into a single slot in the display case 102. The divider bridge 1402 is a divider for use in separating items in a container, supporting items in the container and/or providing additional structural support to the container, such as, but not limited to, the divider bridge 120 in FIG. 1. A side panel 1404 of the divider bridge 1402 is placed against an interior surface of a side member of the display case 102. Items, such as item 1406 and item 1408 are placed into the display case 102. The horizontal panel sits above the items inside the box. A second side panel 1410 includes a guide tab. The guide tab inserts into a single receiving slot in the interior of the opposite side member of the display case 102. In other words, in this non-limiting example, the display case can include a single receiving slot as well as one or more receiving slots. The divider can include a single guide tab as well as two or more guide tabs.

Thus, in some examples, the divider includes a single tab on a single panel of the divider. In other examples, the divider includes two tabs with one tab on each side panel on each end of the unfolded divider. In these examples, a single tab is inserted into a single slot while the other tab is not inserted into another receiving slot. In other examples, there are two guide tabs on the divider and each tab is inserted into a receiving slot on opposite sides of the interior of the display case.

The divider in this example is in a folded, upside-down "U" shaped configuration. However, the examples are not limited to the divider as shown in this example. The divider may be implemented in other configurations, such as, but not limited to, an unfolded configuration, an M shaped configuration, a W shaped configuration, a U shaped configuration, etc.

Figure 15:
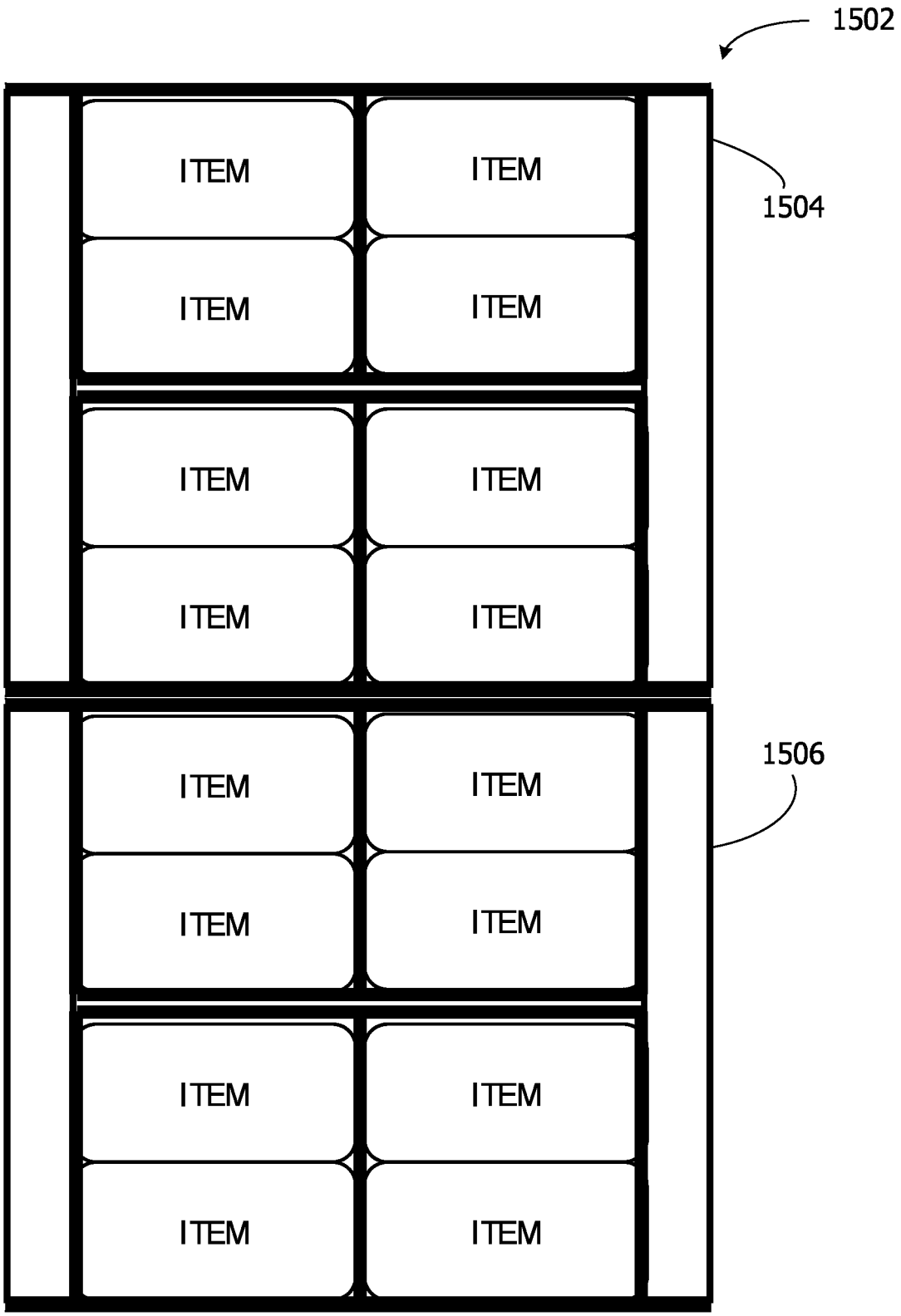
FIG. 15 is an exemplary block diagram illustrating a set of display cases in a stacked configuration.

FIG. 15 is an exemplary block diagram illustrating a set of display cases 1502 in a stacked configuration. In this example, a first case 1504 is stacked on top of a second case 1506. Each case in the set of display cases 1502 includes a first divider bridge in an M configuration and a second divider bridge in a W configuration. The divider bridge in the M configuration sits below the divider bridge in the W configuration. In other words, the horizontal panel of the divider in the W configuration sits flush on top of the horizontal panel of the divider bridge in the M configuration.

Figure 16:
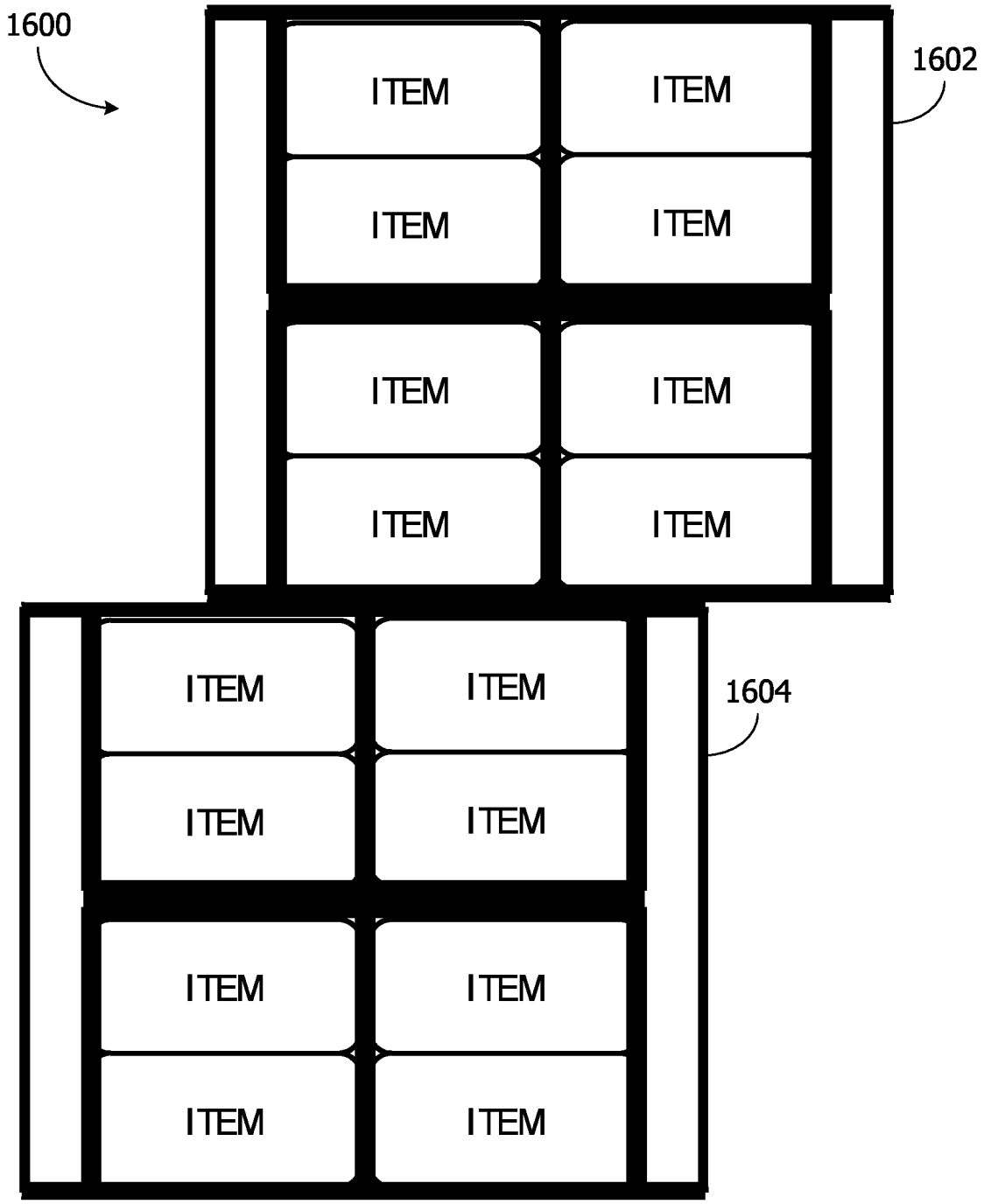
FIG. 16 is an exemplary block diagram illustrating a set of display cases including a set of divider bridges in an unevenly stacked configuration.

FIG. 16 is an exemplary block diagram illustrating a set of display cases 1600 including a set of divider bridges in an unevenly stacked configuration. In this non-limiting example, a display case 1602 is stacked unevenly on top of a display case 1604. Each display case includes two divider bridges. The divider bridge in the M configuration and the divider bridge in the W configuration within the case 1604 reinforces the case 1604 to prevent the top and/or sides of the case from bending, breaking, bowing, or otherwise deforming, which could result in damage to soft product inside the case 1604. Likewise, the divider bridges inside the case 1602, reinforces the bottom and sides of the case 1602 to prevent the base member and/or sides of the case 1602 from bowing, bending, breaking, perforating, or otherwise deforming. This reduces potential damage to soft product inside the case 1602 when the case is unevenly stacked.

Thus, the divider bridge allows stacking boxes imperfectly and/or compensates for incorrectly stacked cases. The divider provides support to cases (boxes) below by improving vertical strength in the case/box. The divider adds supports to stacked cases by providing two points of contact for improved integrity.

Figure 17:
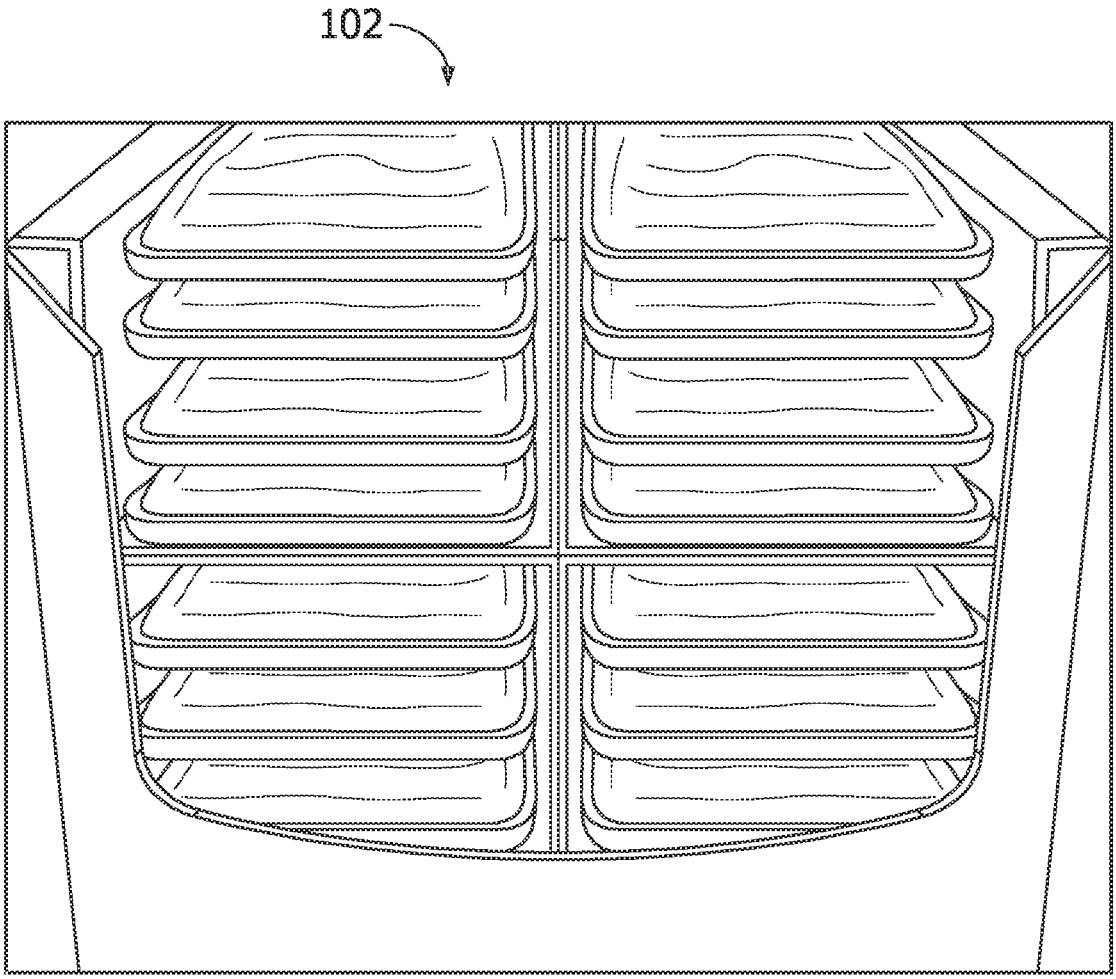
FIG. 17 is an exemplary block diagram illustrating a display case having a portion of an exterior of the case removed to permit display of a portion of the contents of the case.

FIG. 17 is an exemplary block diagram illustrating a display case 102 having a portion of an exterior of the case 102 removed to permit display of a portion of the contents of the case 102. In this example, a first divider bridge separates items stored/displayed in a bottom portion of the case 102 beneath the first divider bridge from items displayed/stored on a second divider bridge in the top portion of the case 102.

Figure 18:
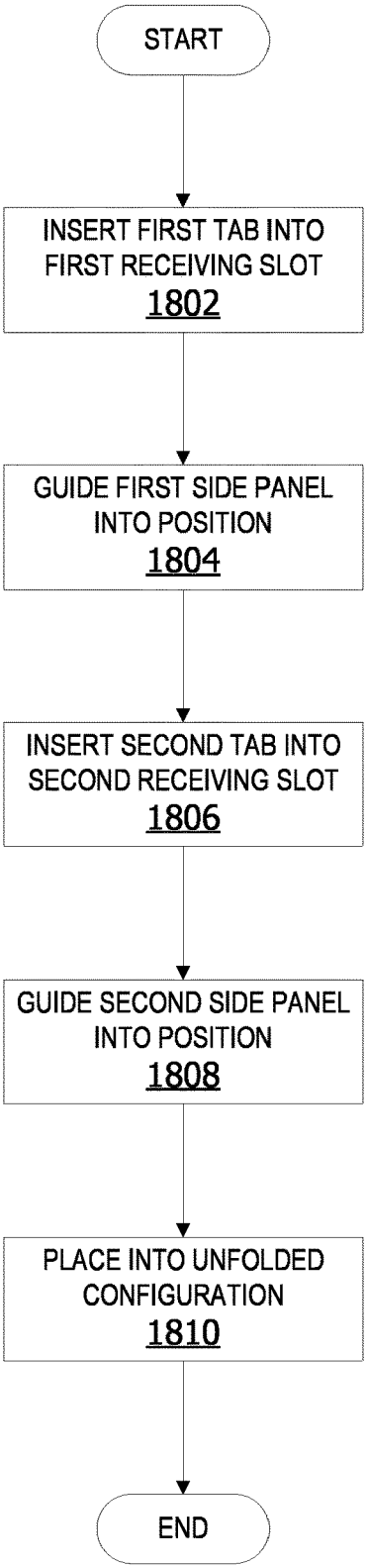
FIG. 18 is an exemplary flow chart illustrating placement of a three-panel divider bridge into a display case via a set of guide tabs and receiving slots.

FIG. 18 is an exemplary flow chart illustrating placement of a three-panel divider bridge into a display case via a set of guide tabs and receiving slots. A user inserts a first guide tab into a first receiving slot within an interior wall of a display case at 1802. In some examples, the tab is not inserted into the slot until a threshold number of items have been placed into a bottom portion of the display case. In one example, the display case is half full when the threshold number of items have been placed into the display case. The receiving slot guides the first side panel into position between the interior side wall of the display case and the items inside the display case at 1804. The user then places a second guide tab into a second receiving slot in the side member of the display case at 1806. The second receiving slot guides the side panel into position between the side of the display case and the items already placed inside the display case at 1808. The user places the divider bridge into the unfolded configuration at 1810. In the unfolded configuration, the tabs are fully inserted into the receiving slots, the side members are in position between the items in the case and the sides of the case, and the horizontal panel is parallel to the base member and perpendicular to the middle panel. The process terminates thereafter.

Figure 19:
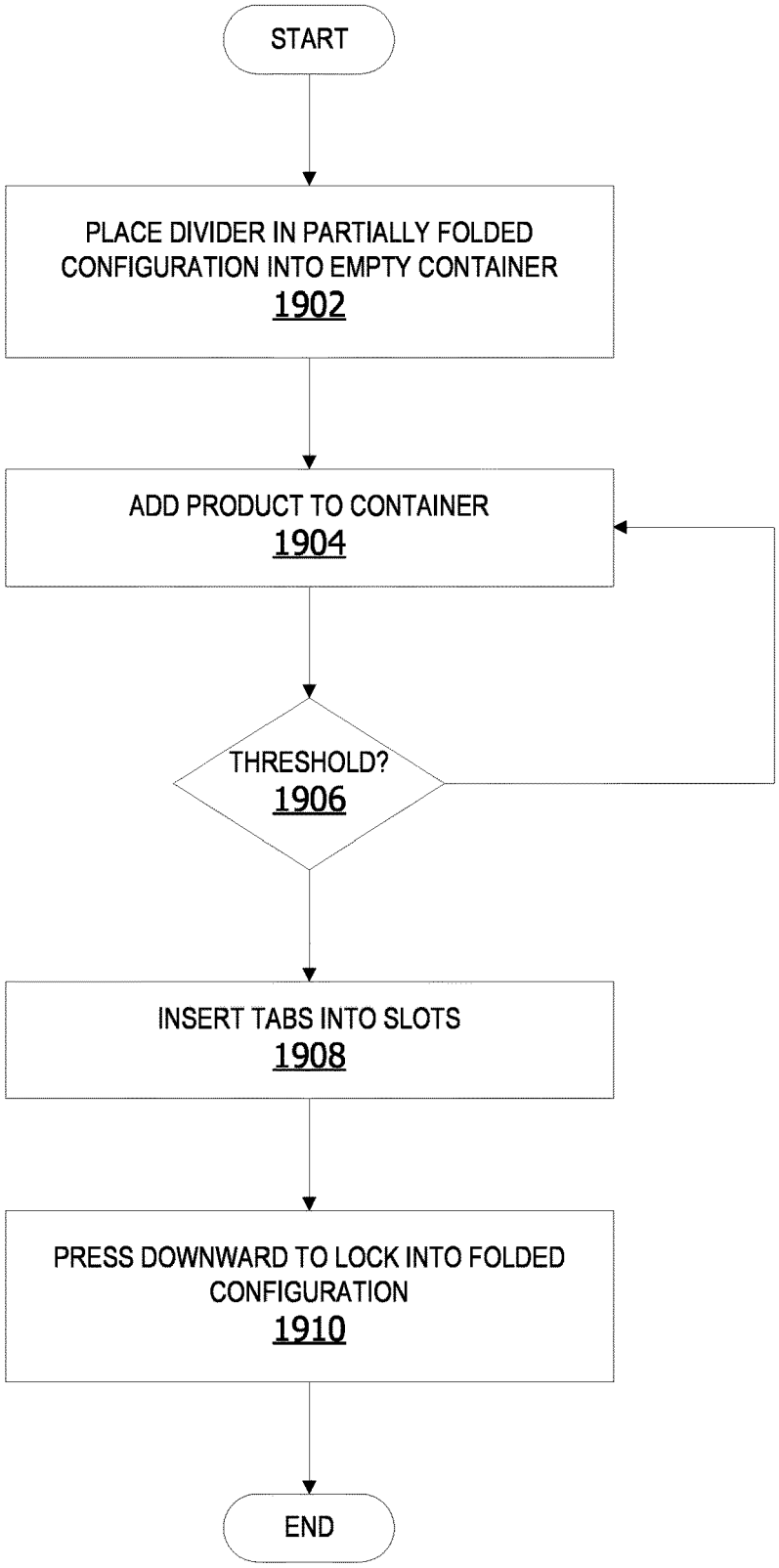
FIG. 19 is an exemplary flow chart illustrating placement of a divider bridge in an "M" configuration into a display case.

FIG. 19 is an exemplary flow chart illustrating placement of a divider bridge in an "M" configuration into a display case. A user places the divider bridge into an empty container (display case) in a partially folded configuration at 1902. In the partially folded configuration, the divider bridge is folded in the middle at a fold line dividing the middle panel down the middle. The user adds product (one or more items) to the inside of the container at 1904. In some examples, product is added to each side of the partially folded divider bridge. A determination is made whether a threshold number of items have been added to the container at 1906. If yes, the user inserts the guide tabs into the receiving slots of the container. The user presses downward on the side panels to lock the sides of the divider bridge into the folded configuration at 1910. The folded configuration can be a U configuration, an upside-down U configuration, an M configuration, and/or a W configuration. The process terminates thereafter.

ADDITIONAL EXAMPLES

In some examples, a container/box includes two receiving slots on interior surfaces of the box. One receiving slot is disposed on a first side and the second receiving slot is disposed on the opposite side. Two tabs are provided on each end of a divider bridge. Each tab slides into the corresponding slot in the interior walls of the box. The tabs guide the side members of the divider into position between the interior walls of the box and the stacks of product inside the bottom half of the box. The divider can be inserted easily by the user as the user is packing the box with product (items) without the user looking away from the conveyor which is bringing product to the user's location.

In other examples, a container/box for transporting/displaying items is provided which includes receiving slots on interior surfaces of the container. The container is a display ready case. One receiving slot on a first side and the second receiving slot is located within the opposite side/wall of the container. A horizontal divider bridge including a horizontal member and two side members. The divider includes tabs that slide into the corresponding slot in the sides of the container (case). The tabs guide the side members of the divider downward around product already placed in the container and into position between the interior walls of the box and the product stacked inside the bottom half of the box. The divider bridge permits smooth and easy insertion of the divider into a partially filled container without damaging the product or taking the user's attention away from a conveyor bringing the product to the user for packing into the container.

The divider bridge, in other examples, inserts into a box/container and acts to take the weight off of the product/packages in the bottom half of the box. Additional product can be stacked on top of the divider. The divider has tabs to hold and guide it into place in the receiving slots in the side of the case. The tabs enable a user to easily slide the sides of the divider between the side walls of the box/container and the product already placed inside the bottom half of the box/container.

The divider can be an "M" shaped divider having a middle panel which extends to the bottom of the case, giving the divider an "M" shape when facing downward inside the box and a "W" shape when placed facing upward inside the box. The divider can be a "U" shaped divider without the middle panel.

In other examples, the divider is inserted and folded flat onto itself. Then as the case is filled with product, the operator can simply flip each half of the divider down and into place without distracting the user. Moreover, a single user can assemble the divider without looking at the divider or looking inside the case. This reduces time and labor required to assemble.

In an example scenario, users receive a display tray at a packing station with the divider bridge folded in half. The first 8 packs of a product, such as meat product, are placed inside the case. This supports the divider. With the divider supported, the user is free to tuck the guiding tabs into the receiving slots and then add another inverted divider on top. The guiding tab allows the operator to guide the divider into the receiving slot without diverting attention from the product flow. The receiving slot allows the divider to pass around the sides of the product without getting jammed. This can be done effortlessly once the guiding tab is engaged in the receiving slot. Small tabs on the divider lock into the sides of the receiving slot keeping it centered in the case so the case and/or product is not compromised in transit.

The divider bridge in other examples permits reduced workload/increased ease of use for human users. The divider bridge permits utilization of less expensive board with increased box strength. The divider bridge incorporates center support for mixed load shipments. The divider keeps product organized. The divider supports the weight of the product above alleviating it from the packages below. Center support from the M and W divider further prevents damage from misaligned cases in stacks.

Alternatively, or in addition to the other examples described herein, examples include any combination of the following:

- a first reinforced storage space, wherein the first side panel, the horizontal panel and the second side panel define the first reinforced storage space within the interior of the display case when the divider bridge is installed in the display case in an unfolded configuration;
- a middle panel located between the first side panel and the second side panel of the divider bridge;
- a first reinforced storage space for storing a first set of items, wherein a middle panel and the first side panel define the first reinforced storage space within the interior of the display case when the divider bridge is folded into an "M" configuration;
- a second reinforced storage space for storing a second set of items, wherein the middle panel, the horizontal panel and the second side panel define the first reinforced storage space within the interior of the display case when the divider bridge is folded into an "M" configuration;
- wherein the divider bridge is a first divider bridge;
- a second divider bridge folded into a "W" configuration, wherein the second divider bridge sits on top of the first divider bridge within the display case, and wherein the second divider bridge defines a third reinforced storage space and a fourth reinforced storage space for storing items within the interior of the display case;

inserting a first tab associated with a first side panel of a first divider bridge into a first receiving slot disposed within an interior surface of a first side member of a display case in response to a determination that a storage space within the display case has reached a threshold level;

guiding, via the first receiving slot, the first side panel into first position between the first side member and at least one item located within an interior space of the display case until the first side member contacts a portion of a base member;

inserting a second tab associated with a second side panel of the first divider bridge into a second receiving slot disposed within an interior surface of a second side member of the display case;

guiding, via the second receiving slot, the second side panel into a second position between the second side member and the at least one item located within the interior space of the display case until the second side member contacts at least a portion of the base member;

placing a horizontal panel into an unfolded configuration parallel to the base member, wherein the horizontal panel forms a divider for separating a first set of items located within a bottom section of the interior of the display case from a top section of the interior of the display case;

placing the divider bridge in a folded configuration into the display case when the display case is empty;

adding the first set of items to the interior portion of the display case;

unfolding the divider bridge into an unfolded configuration after a number of items in the first set of items being placed into the bottom portion of the interior of the display case has reached the threshold level;

installing the divider bridge into the display case in an "M" configuration, wherein the divider bridge defines a first reinforced storage space for storing a first set of items between a middle panel and the first side panel;

storing a second set of items within a second reinforced storage space defined by the middle panel, the horizontal pane and the second side panel;

placing a second divider bridge folded into a "W" configuration on top of the first divider bridge within the display case;

storing a third set of items within a third reinforced storage space defined by the second divider bridge;

storing a fourth set of items within a fourth reinforced storage space defined by the second divider bridge within the interior of the display case;

a first guide tab associated with a first side panel, the first guide tab sized to fit within a first receiving slot of a display case, wherein the first receiving slot guides the first side panel between an interior surface of a first side member of the display case and a first set of items associated with an interior space of the display case as the configurable divider bridge is unfolded;

a second guide tab associated with a second side panel, the second guide tab sized to fit within a second receiving slot of the display case, wherein the second receiving slot guides the second side panel between the interior surface of a second side member of the display case and a second set of items located within a second storage space associated with the bottom portion of the interior of the display case;

a horizontal panel parallel to a base member of the display case when the divider bridge is in an unfolded configuration, wherein the horizontal panel with the first side panel and the second side panel define a reinforced storage space for the first set of items and the second set of items;

a middle panel located between the first side panel and the second side panel forming a vertical divider defining a first reinforced storage space between the first side panel and the middle panel and a second reinforced storage space between the second side panel and the middle panel;

an "M" configuration of the configurable divider bridge, wherein the divider bridge in the "M" configuration defines a first reinforced storage space and a second reinforced storage space within the display case;

a "W" configuration of the configurable divider, wherein the divider bridge in the "W" configuration defines a third reinforced storage space and a fourth reinforced storage space within a top portion of the interior of the display case;

a first fold line separating the horizontal panel and the first side panel, wherein the configurable divider bridge folds at the first fold line for insertion of the first tab into the first receiving slot;

a second fold line separating the horizontal panel and the second side panel, wherein the second side panel folds downward at the second fold line for insertion of the second tab into the second receiving slot; and a third fold line bisecting the middle panel, wherein the middle section folds at the third fold line to form a double-layered middle support member that sits between the first set of items and the second set of items inside the display case, wherein the middle support member divides a bottom portion of the interior of the display case vertically to form two reinforced storage spaces.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing an operation before, contemporaneously with, or after another operation is within the scope of aspects of the disclosure.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e., "one or the other but not both") when preceded by terms of exclusivity, such as "either", "one of", "only one of", or "exactly one of" "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A configurable divider bridge system comprising:

a display case having a first receiving slot associated with an interior surface of a first side member and a second receiving slot associated with the interior surface of a second side member, the first receiving slot opposite to the second receiving slot;

a first divider bridge folded in an "M" configuration comprising:

a first guide tab associated with a first side panel, the first guide tab sized to fit within the first receiving slot, the first receiving slot guides the first side panel between the first side member of the interior surface of the display case and at least one item located within a storage space associated with an interior of the display case downward toward a base member of the display case when the first guide tab is engaged with the first receiving slot during installation of the first divider bridge into the display case;

a second guide tab associated with a second side panel, the second guide tab sized to fit within the second receiving slot, the second receiving slot guides the second side panel between the second side member of the interior surface of the display case and at least one item located within a storage space associated with the interior of the display case downward toward the base member of the display case when the second guide tab is engaged with the second receiving slot during installation of the first divider bridge into the display case;

a first horizontal panel having a length equal to a length of the display case and a width equal to the width of the display case, wherein the first horizontal panel is parallel to the base member when the first divider bridge is in an unfolded configuration, wherein the first side panel, the first horizontal panel and a middle panel define a first reinforced storage space for the at least one item, wherein the middle panel, the first horizontal panel, and the second side panel define a second reinforced storage space, wherein the first divider bridge separates a bottom section of the interior of the display case from a top section of the interior of the display case; and a second divider bridge folded into a "W" configuration, wherein the second divider bridge sits on top of the first divider bridge within the display case, wherein the second divider bridge defines a third reinforced storage space and a fourth reinforced storage space for storing items within the interior of the display case.

2. The configurable divider bridge system of claim 1, further comprising:

a first reinforced storage space, wherein the first side panel, the first horizontal panel and the second side panel define the first reinforced storage space within the interior of the display case when the first divider bridge is installed in the display case in an unfolded configuration.

3. The configurable divider bridge system of claim 1, further comprising:

the middle panel located between the first side panel and the second side panel of the first divider bridge forming a vertical divider defining a first reinforced storage space between the first side panel and the middle panel and a second reinforced storage space between the second side panel and the middle panel, wherein a third fold line bisects the middle panel, wherein the middle panel folds at the third fold line to form a double-layered middle support member that sits between a first set of items and a second set of items inside the display case.

4. The configurable divider bridge system of claim 1, further comprising:

a first reinforced storage space for storing a first set of items, wherein the middle panel and the first side panel define the first reinforced storage space within the interior of the display case when the first divider bridge is folded into the "M" configuration.

5. The configurable divider bridge system of claim 4, further comprising:

a horizontal panel that rests on top of a flat surface, wherein two side members extend upward on each side of the first divider bridge when the first divider bridge is folded into a "U" configuration, wherein the horizontal panel forms a platform on which items may be stacked.

6. The configurable divider bridge system of claim 5, further comprising:

a horizontal panel sitting on top of two downward oriented side panels when the first divider bridge is folded into an upside down "U" configuration, wherein an item is placed beneath the horizontal panel in the upside down "U" configuration.

7. A configurable divider bridge comprising:

a guide tab associated with a first side panel, the guide tab sized to fit within a receiving slot of a display case, wherein the receiving slot guides the first side panel between an interior surface of a first side member of the display case and a set of items associated with an interior of the display case as the configurable divider bridge is unfolded into an "M" configuration;

a second side panel between the interior surface of a second side member of the display case and the set of items located within a bottom portion of the interior of the display case;

a horizontal panel parallel to a base member of the display case when the configurable divider bridge is in the "M" configuration, wherein the horizontal panel with the first side panel and the second side panel define a reinforced storage space for the set of items; and a "W" configuration of the configurable divider bridge, wherein the configurable divider bridge in the "W" configuration defines a first reinforced storage space and a second reinforced storage space within a top portion of the interior of the display case.

8. The configurable divider bridge of claim 7, further comprising:

a middle panel located between the first side panel and the second side panel forming a vertical divider defining the first reinforced storage space between the first side panel and the middle panel and a second reinforced storage space between the second side panel and the middle panel.

9. The configurable divider bridge of claim 7, wherein the configurable divider bridge in the "M" configuration defines a third reinforced storage space and a fourth reinforced storage space within the display case.

10. The configurable divider bridge of claim 7, further comprising:

a set of holes in the horizontal panel to facilitate removal of the configurable divider bridge from the display case.

11. The configurable divider bridge of claim 7, further comprising:

a first fold line separating the horizontal panel and the first side panel, wherein the first side panel folds at the first fold line for insertion of the guide tab into the receiving slot.

12. The configurable divider bridge of claim 11, further comprising:

a second fold line separating the horizontal panel and the second side panel, wherein the second side panel folds downward at the second fold line for insertion of the second side panel into the display case.

13. The configurable divider bridge of claim 12, further comprising:

a third fold line bisecting a middle panel, wherein the middle panel folds at the third fold line to form a double-layered middle support member that sits between a first set of items and a second set of items inside the display case, wherein the middle support member divides a bottom portion of the interior of the display case vertically to form two reinforced storage spaces.

14. A configurable divider bridge comprising:

a horizontal panel parallel to a base member when the configurable divider bridge is in an unfolded configuration, having a length equal to a length of a display case and a width equal to the width of the display case;

a first side panel adjacent to the horizontal panel, wherein a first fold line separates the first side panel from the horizontal panel;

a second side panel, wherein a second fold line separates the second side panel from the horizontal panel;

a middle panel located between the first side panel and the second side panel of the configurable divider bridge folded along a fold line to form a middle support between the first side panel and the second side panel; and a "W" shaped configuration of the configurable divider bridge, wherein the first side panel, the second side panel, and the middle panel are folded along a set of fold lines, wherein the horizontal panel is configured to rest on a second horizontal panel of a second configurable divider bridge in an "M" configuration, wherein the first side panel, the horizontal panel and the middle panel define a first reinforced storage space for storing items within an interior of the display case, a second side panel, the horizontal panel and the middle panel define a second reinforced storage space items within the interior of the display case.

* * * * *